US008274453B2

(12) United States Patent
Park et al.

(10) Patent No.: US 8,274,453 B2
(45) Date of Patent: Sep. 25, 2012

(54) ORGANIC ELECTRO LUMINESCENCE DISPLAY AND DRIVING METHOD OF THE SAME

(75) Inventors: Young-jong Park, Suwon-si (KR); Jang-doo Lee, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1378 days.

(21) Appl. No.: 11/907,826

(22) Filed: Oct. 17, 2007

(65) Prior Publication Data

US 2008/0218448 A1 Sep. 11, 2008

(30) Foreign Application Priority Data

Mar. 8, 2007 (KR) ..... 10-2007-0022937

(51) Int. Cl.
*G09G 3/30* (2006.01)

(52) U.S. Cl. ..... 345/76; 345/77

(58) Field of Classification Search ..... 345/76–84; 315/169.3

See application file for complete search history.

(56) References Cited

U.S. PATENT DOCUMENTS

| | | | | |
|---|---|---|---|---|
| 6,771,243 | B2 * | 8/2004 | Hirohata | 345/89 |
| 7,027,074 | B2 * | 4/2006 | Koyama | 345/691 |
| 7,324,123 | B2 * | 1/2008 | Yamazaki et al. | 345/690 |
| 7,330,169 | B2 * | 2/2008 | Koyama | 345/77 |
| 7,502,039 | B2 * | 3/2009 | Koyama et al. | 345/690 |
| 7,782,279 | B2 * | 8/2010 | Lee et al. | 345/82 |
| 8,022,902 | B2 * | 9/2011 | Lee | 345/76 |
| 2004/0095364 | A1 * | 5/2004 | Koyama et al. | 345/690 |
| 2004/0196271 | A1 | 10/2004 | Kaneyasu | |
| 2005/0057191 | A1 * | 3/2005 | Jo et al. | 315/291 |
| 2005/0195178 | A1 * | 9/2005 | Jo et al. | 345/204 |
| 2006/0071888 | A1 * | 4/2006 | Lee et al. | 345/82 |
| 2006/0220578 | A1 * | 10/2006 | Park et al. | 315/169.3 |

(Continued)

FOREIGN PATENT DOCUMENTS

| | | |
|---|---|---|
| JP | 2003-228331 | 8/2003 |
| JP | 2005-189636 | 7/2005 |
| JP | 2005-301095 | 10/2005 |
| JP | 2006-038967 | 2/2006 |

(Continued)

OTHER PUBLICATIONS

Korean Notice of Allowance for corresponding Korean Patent Application No. 2007-0022937 issued on Aug. 29, 2008.

*Primary Examiner* — Jason Mandeville
(74) *Attorney, Agent, or Firm* — Robert E. Bushnell, Esq.

(57) ABSTRACT

Disclosed are an organic electro luminescence display and a driving method of the same. The present invention provides an organic electro luminescence display including a pixel unit for displaying an image to correspond to a scan signal, a light emission control signal and a data line. The image is composed of a plurality of frames. The organic electro luminescence display of the present invention includes a scan driver for supplying the scan signal and the light emission control signal to the pixel unit, a data driver for generating a data signal with a video data to supply the generated data signal to the pixel unit, a control unit for controlling a pulse width of the light emission control signal using a frame data which is the sum of the video data inputted to one frame and controlling one frame time according to the size of the frame data, and a power supply unit for supplying a first power and a second power to the pixel unit.

25 Claims, 5 Drawing Sheets

U.S. PATENT DOCUMENTS

| | | | | |
|---|---|---|---|---|
| 2006/0244697 | A1* | 11/2006 | Lee et al. | 345/77 |
| 2006/0262054 | A1* | 11/2006 | Yamazaki et al. | 345/77 |
| 2007/0103410 | A1* | 5/2007 | Oh | 345/77 |
| 2008/0218450 | A1* | 9/2008 | Park | 345/76 |
| 2008/0285360 | A1* | 11/2008 | Sakimura et al. | 365/189.15 |

FOREIGN PATENT DOCUMENTS

| | | |
|---|---|---|
| JP | 3799297 | 4/2006 |
| KR | 10-2006-0046635 | 5/2006 |
| KR | 20060104855 | 10/2006 |

* cited by examiner

ORGANIC ELECTRO LUMINESCENCE DISPLAY AND DRIVING METHOD OF THE SAME

CLAIM OF PRIORITY

This application makes reference to, incorporates the same herein, and claims all benefits accruing under 35 U.S.C. §119 from an application for ORGANIC ELECTRO LUMINESCENCE DISPLAY AND DRIVING METHOD OF THE SAME earlier filed in the Korean Intellectual Property Office on the 8 of Mar. 2007 and there duly assigned Serial No. 10-2007-0022937.

BACKGROUND OF THE INVENTION

1. Field of the Invention

The present invention relates to an organic electro luminescence display and a driving method of the same, and more particularly to an organic electro luminescence display capable of reducing a power consumption and improve picture quality of the display by determining a range limit of luminance to correspond to the sum of data inputted to a pixel unit, and a driving method of the same.

2. Description of Related Art

In recent years, a variety of flat panel displays, which have lower weight and volume than cathode ray tubes, have been developed. In particular, organic electro luminescence displays have attracted public attention. The organic electro luminescence displays have excellent properties such as luminous efficiency, luminance and viewing angle, as well as a rapid response time.

The organic electro luminescence displays an image using a plurality of organic light emitting diodes (OLED), and the organic light emitting diodes include an anode electrode, a cathode electrode and an organic light emission layer arranged between the anode electrode and the cathode electrode. The organic light emitting diodes emit light by coupling of electrons with holes.

Luminance of an organic light emitting diode depends on an amount of electric current flowing into the organic light emitting diode. The luminance of the organic light emitting diode increases when the amount of electric current increases, and decreases when the amount of electric current decreases. Therefore, various grey levels are achieved by controlling the amount of electric current flowing into the organic light emitting diode.

Accordingly, in order to solve the above problems, a power supply unit that allows high electric current may be required. The use of the power supply unit, however, increases production cost. Also, sudden increase in the electric current capacity may cause a driving interruption.

SUMMARY OF THE INVENTION

Accordingly, the present invention is designed to solve such drawbacks of the prior art, and therefore an object of the present invention is to provide an organic electro luminescence display capable of reducing a power consumption by limiting an electric current capacity to correspond to the sum of data inputted during one frame period and of improving a quality in pictures by increasing a contrast, and a driving method of the same.

The first aspect of the present invention is achieved by providing an organic electro luminescence display including a pixel unit for displaying an image to correspond to a scan signal, a light emission control signal and a data line. The image is composed of a plurality of frames. The organic electro luminescence display of the present invention further includes a scan driver for supplying the scan signal and the light emission control signal to the pixel unit, a data driver for generating a data signal with a video data to supply the generated data signal to the pixel unit, a control unit for controlling a pulse width of the light emission control signal using a frame data which is the sum of the video data inputted to one frame and controlling one frame time according to the size of the frame data, and a power supply unit for supplying a first power source and a second power source to the pixel unit.

The second aspect of the present invention is achieved by providing an organic electro luminescence display including a pixel unit for displaying an image that is composed of a plurality of frames, a scan driver for supplying the scan signal and the light emission control signal to the pixel unit, a data driver for generating a data signal with a video data to supply the generated data signal to the pixel unit, a control unit for controlling a pulse width of the light emission control signal using a frame data which is the sum of the video data inputted to one frame and controlling one frame time according to the size of the frame data, and a power supply unit for supplying a first power source and a second power source to the pixel unit. The data driver generates a black data signal and supplies the generated black data signal to the pixel unit in case that a size of the frame data is greater than a predetermined value in the step of summing up the video data.

The third aspect of the present invention is achieved by providing an organic electro luminescence display including a pixel unit for displaying an image that is composed of a plurality of frames, a scan driver for supplying the scan signal and the light emission control signal to the pixel unit, a data driver for generating a data signal with a video data to supply the generated data signal to the pixel unit, a control unit for controlling a pulse width of the light emission control signal using a frame data which is the sum of the video data inputted to one frame and controlling one frame time according to the size of the frame data, wherein a first frame and a second frame are stored in different memories, and a power supply unit for supplying a first power source and a second power source to the pixel unit.

The fourth aspect of the present invention is achieved by providing a method for driving an organic electro luminescence display which displays an image to correspond to a scan signal, a light emission control signal and a data line. The image is composed of a plurality of frames. The method includes steps of estimating a frame data which is the sum of a video data stored in a frame memory and controlling one frame period to correspond to a size of the frame data (step 1), estimating a luminance range limit of a pixel unit to correspond to the frame data (step 2), and generating a light emission control signal according to the luminance range limit, wherein a pulse width and the number of the light emission control signal is determined to correspond to the luminance range limit (step 3).

The fifth aspect of the present invention is achieved by providing a method for driving an organic electro luminescence display which displays an image to correspond to a scan signal, a light emission control signal and a data line. The image is composed of a plurality of frames. The method includes steps of estimating a frame data which is the sum of a video data stored in a frame memory (step 1), supplying a black data by means of the data signal if the size of the frame data is greater than a predetermined value in the step of summing the frame data (step 2), estimating a luminance range limit of a pixel unit to correspond to the frame data (step 3), and generating a light emission control signal according to the luminance range limit, wherein a pulse width and the number of the light emission control signal is determined to correspond to the luminance range limit (step 4).

The sixth aspect of the present invention is achieved by providing a method for driving an organic electro luminescence display which displays an image to correspond to a scan signal, a light emission control signal and a data line. The image is composed of a plurality of frames. The method includes steps of storing a video data, inputted to a first frame out of a plurality of the frames, in a first frame memory (step 1), summing the stored video data to generate a frame data after the first frame is stored (step 2), estimating a luminance range limit of a pixel unit to correspond to the frame data (step 3), generating a light emission control signal according to the luminance range limit, wherein a pulse width and the number of the light emission control signal is determined to correspond to the luminance range limit (step 4), storing a video data, inputted to a second frame out of a plurality of the frames, in a second frame memory (step 5), summing up the stored video data to generate a frame data after the second frame is stored (step 6), estimating a luminance range limit of a pixel unit to correspond to the frame data (step 7), and generating a light emission control signal according to the luminance range limit, wherein a pulse width and the number of the light emission control signal is determined to correspond to the luminance range limit (step 8).

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
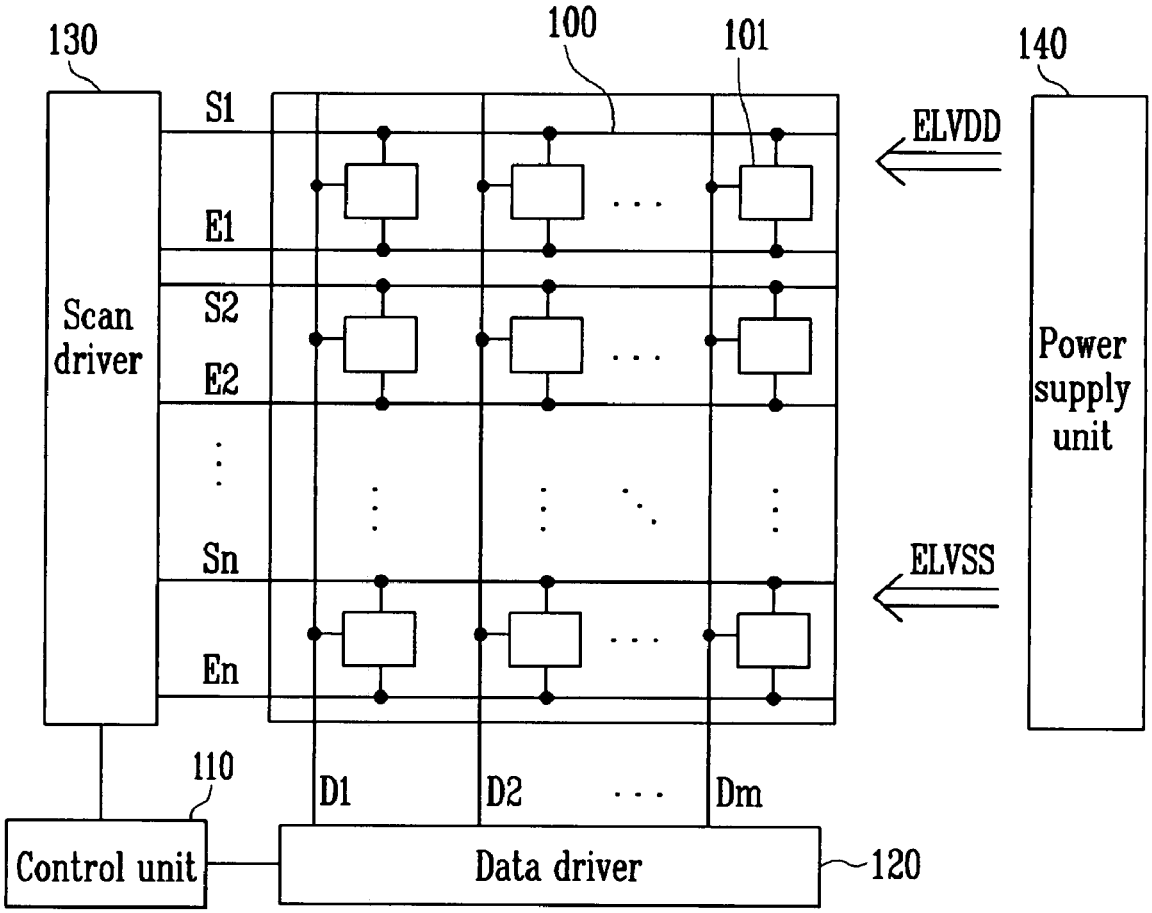
FIG. 1 is a schematic view showing a configuration of an organic electro luminescence display according to the present invention.

Hereinafter, preferable embodiments according to the present invention will be described with reference to the accompanying drawings. Here, when one element is connected to another element, one element may be not only directly connected to another element but also indirectly connected to another element via another element. Further, irrelevant elements are omitted for clarity. Also, like reference numerals refer to like elements throughout.

FIG. 1 is a schematic view showing a configuration of an organic electro luminescence display according to the present invention. Referring to FIG. 1, the organic electro luminescence display includes a pixel unit 100, a control unit 110, a data driver 120, a scan driver 130 and a power supply unit 140.

The pixel unit 100 has a plurality of pixels 101 arranged therein, and each of pixels 101 includes an organic light emitting diode (not shown) which emits light in response to an amount of electric current flowing into each of the pixels 101. The pixel unit 100 includes n number of scan lines (S1, S2, . . . Sn−1, Sn) formed in a horizontal direction and supplying a scan signal, n number of light emission control signal lines (E1, E2, . . . En−1, En) for supplying a light emission control signal, and m number of data lines (D1, D2, . . . Dm−1, Dm) formed in a vertical direction and supplying a data signal, which are sequentially arranged in the pixel unit 100. Also, the pixel unit 100 is driven by receiving a first power (ELVDD) and a second power (ELVSS) from the power supply unit 140. Accordingly, the pixel unit 100 displays an image by receiving the scan signal, the data signal, the first power (ELVDD) and the second power (ELVSS).

If a sum of input data (i.e. a sum of a gray level of each pixel) is large, which means that more pixels emit light with high luminance than low luminance, the pixel unit 100 displays an image with overall high luminance. If a sum of the input data is small, more pixels emit light with low luminance than high luminance, and therefore, the pixel unit 100 displays an image with overall low luminance. If the pixel unit 100 is emitted light with high luminance, glaring and the like may be caused in the pixel unit 100, and a power consumption increases to a significant level, because high luminance requires high electric current in the case of the organic light emitting diode.

The control unit 110 supplies a digital signal, such as a video data and a predetermined control signal, to a data driver 120 and a scan driver 130, so that the data driver 120 and the scan driver 130 can be properly operated. Additionally, the control unit 110 prevents increase of power consumption by estimating brightness per one frame and by limiting an amount of electric current flowing in the pixel unit 100. The predetermined control signal means a clock, a horizontal synchronizing signal, a vertical synchronizing signal, a luminance control signal, etc.

The limitation applied to the amount of electric current depends on the overall brightness of an image of a frame. Brightness difference between grey levels is adjusted to be relatively large if the overall brightness of the image of the frame is low. The brightness difference between grey levels is adjusted to be relatively small if the overall brightness of the image of the frame is high. Therefore, this adjustment of the brightness difference improves visibility of the display. For example, if a large number of pixels emit light at low grey level and only a small number of pixels emit light at high grey level, the image formed of these pixels may represent some bright regions (or objects) over relatively dark background. As described above, the brightness difference between grey levels increases in this case, and therefore, a viewer feels that a dark region is darker and a bright region is brighter, resulting in improvement in visibility. If most of an image of a frame is displayed with a high grey level and some of the image of the frame is displayed with a low grey level, then a brightness difference between the grey levels decreases, and therefore glaring and the like are prevented, because the brightness in the region of the high grey level is lowered, resulting in improvement in visibility.

The data driver 120 is a means for applying a data signal to the pixel unit 100, and receives a video data having red, blue and green components to generate a data signal. And, the data driver 120 is connected to the data lines (D1, D2, . . . Dm−1, Dm) of the pixel unit 100 to apply the generated data signal to the pixel unit 100.

The scan driver 130 is a means for applying a scan signal and a light emission control signal to the pixel unit 100, and the scan driver 130 is connected to the scan lines (S1, S2, . . . Sn−1, Sn) and the light emission signal lines (E1, E2, . . . En−1, En) to supply a scan signal and a light emission control signal to certain rows of the pixel unit 100. The data signal outputted from the data driver 120 is supplied to the pixel unit 100 to which the scan signal is supplied, and the pixels 101 to which the light emission control signal is supplied emits light according to the light emission control signal.

The data signal inputted from the data driver 120 is applied to certain columns of the pixel unit 100 to which the scan signal is supplied. A time period, during which an electric current corresponding to the data signal is supplied to the organic light emitting diode, is determined by a pulse width of the light emission control signal. As a result, the data driver 120 controls light emission time of the organic light emitting diode. The pulse width of the light emission control signal is determined by the luminance control signal, and the luminance control signal is generated in the control unit 110.

Also, the scan driver 130 may be divided into two groups: a scan drive circuit for generating a scan signal and a light emission drive circuit for generating a light emission control signal. The scan drive circuit and the light emission drive circuit may be provided in one component or provided in separate components.

The power supply unit 140 supplies a first power (ELVDD) and a second power (ELVSS) to the pixel unit 100 to allow an electric current corresponding to the data signal to flow in each of the pixels due to a level difference between the first power (ELVDD) and the second power (ELVSS). And, even if the sum of video data inputted to one frame is high, a power consumption is not increased due to a high luminance range limit, resulting in reduction in the entire power consumption.

Figure 2:
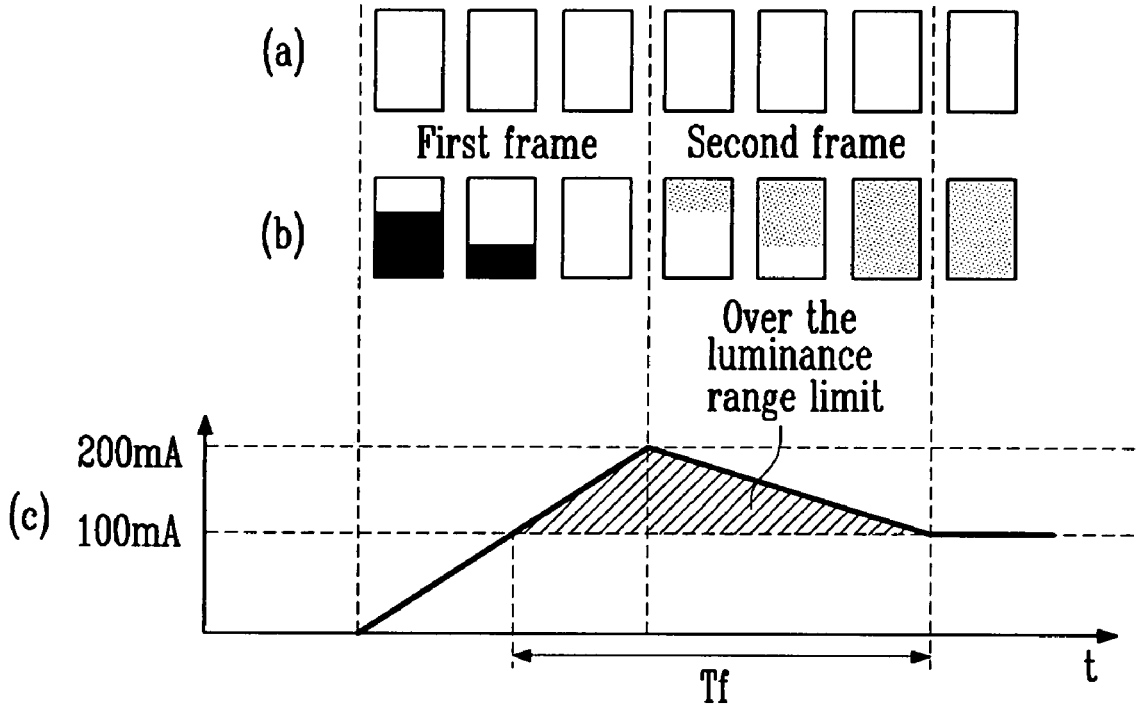
FIG. 2 is a diagram showing principles of a first embodiment of a driving scheme of the organic electro luminescence display as shown in FIG. 1.

FIG. 2 is a diagram showing a first embodiment of driving principles of the organic electro luminescence display shown in FIG. 1. Referring to FIG. 2, an input data, which makes the screen display white color (highest grey level), is inputted to the pixel unit. FIG. 2(*a*) represents states of the pixels that is desired by this input data. FIG. 2(*b*) represents an image displayed in the pixel unit as a function of time. FIG. 2(*c*) represents a curve showing an amount of electric current flowing into the pixel unit as a function of time. The range limit of the electric current is assumed to be 100 mA.

First, a first frame and a second frame are desired to be display with a white color by the inputted video data, as shown in FIG. 2(*a*). However, the first frame and the second frame are actually displayed as shown in FIG. 2(*b*) due to the time lag while the data is inputted to the pixels, etc. That is to say, during a certain time interval in the first frame, a data signal is supplied to ⅓ of the screen. After a certain amount of time passes in the first frame, a data signal is supplied to ⅔ of the screen. Again after a certain amount of time passes in the first frame, a data signal is supplied to the entire screen. In the case of the second frame, a region displayed in the screen is also enlarged with the passage of time in the same manner as in the first frame.

A data sum-up unit sums video data supplied to the one frame, and then determines a luminance range limit. In the case, the video data supplied to the first frame may be used to determine a luminance range limit in the luminance control unit, but may not be used to determine limitation on the luminance, because the video data is supplied to the pixel unit during a period in which the video data is added in the data sum-up unit in the case of the first frame. Accordingly, the light emission time is not controlled even if the entire screen is displayed with a white color, and therefore an electric current flowing in the pixel unit exceeds the range limit, because the limitation on the electric current is not applied. That is to say, an electric current is supplied to the pixel unit during a certain time period in the first frame, and at the moment that a predetermined area of the pixel unit emits white color, the amount of the electric current exceeds the range limit. The amount of the electric current becomes maximum around at the end of the first frame.

A range limit is determined for the second frame by the use of the video data supplied to the first frame, but the amount of the electric current flowing in the pixel unit exceeds the range limit at a beginning when the data corresponding to the second frame is inputted, because the light emission is sustained by the data of the first frame. Accordingly, the amount of the electric current flowing in the pixel unit exceeds the range limit until the second frame is completed. The electric current flows below the range limit in the pixel unit from a third frame.

If the amount of the electric current flowing in the first frame and the second frame exceeds the range limit as described above, then a large electric load is applied to the power supply unit, resulting in unreasonable impact on the power supply unit. In order to solve the above problems, firstly, a frequency is amplified to accelerate operations of the first frame and the second frame while the first frame and the second frame are driven, and therefore the time interval (Tf), in which the electric current exceeds the range limit in the first frame and the second frame as shown in row (c) of FIG. 2, is shortened to reduce an area of a region in which the electric current overflows. In other words, frame times (or frame period) of the first frame and the second frame are controlled by controlling the frequency in order to shorten the time interval (Tf) in which the electric current exceeds the range limit in the first frame and the second frame. In this manner, load applied to the power supply unit is lowered by reducing the amount of the electric current. In order to accelerate the operations of the first frame and the second frame, cycles of the clock, the horizontal synchronizing signal, the vertical synchronizing signal and the like generated in the control unit are operated rapidly. And, since the pixels emitting light with high luminance is generally present in a larger number if the inputted image is a still image than if the inputted image is a moving image, the time period in which the electric current exceeds the range limit may be reduced by accelerating driving of the frames if it is estimated that the inputted image is a still image. As a method for distinguishing a still image from a moving image, an image is estimated to be a still image if the sum of grey levels of the video data inputted to one frame exceeds a predetermined value when a large number of the pixels displayed with a high luminance are included in the still image.

Figure 3:
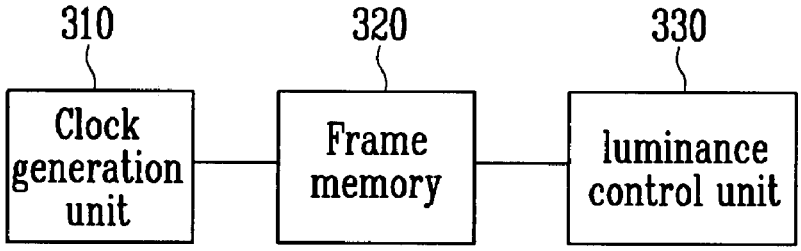
FIG. 3 is a schematic view showing blocks of a control unit used for driving the organic electro luminescence display as proposed in the driving scheme shown in FIG. 2.

FIG. 3 is a schematic view showing blocks of a control unit used for the organic electro luminescence display driven as shown in FIG. 2. Referring to FIG. 3, the control unit includes a clock generation unit 310, a frame memory 320 and a luminance control unit 330.

The clock generation unit 310 detects whether the input image is one of a moving image or a still image, and generates a clock among a plurality of clocks. If the inputted image is a still image, a frequency of the clock generated has more rapid cycles than that of the clock generated if the inputted image is a moving image. The frame memory 320 receives and stores video data (RGB data) inputted from the outside. And, the luminance control unit 330 estimates the sum of grey level values of the video data inputted to one frame to determine a luminance range limit of the one frame.

Figure 4:
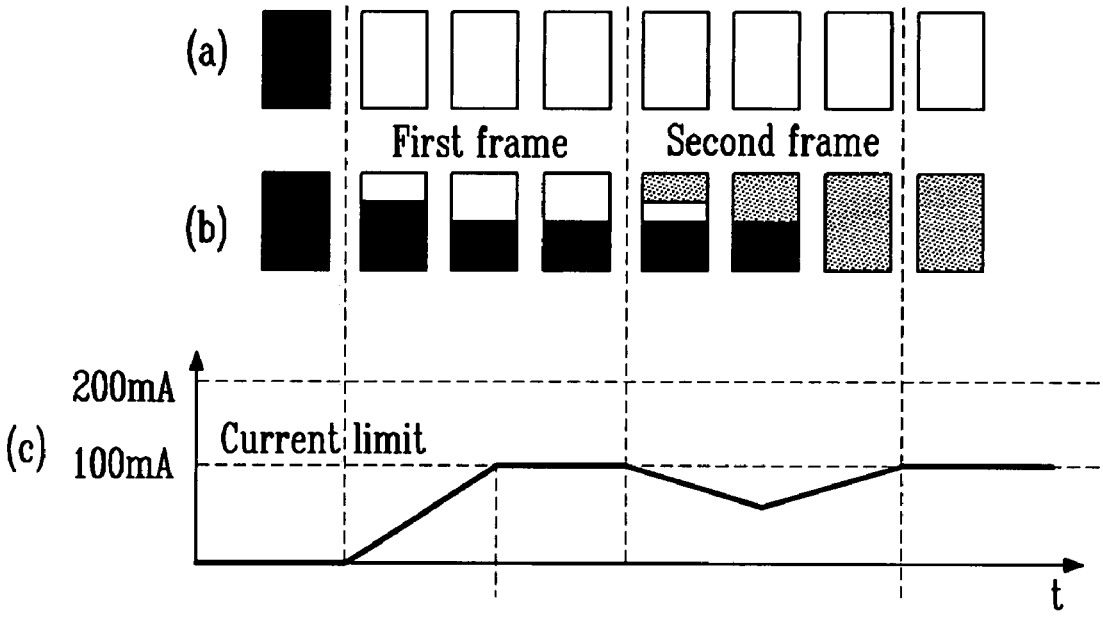
FIG. 4 is a diagram showing principles of a second embodiment of a driving scheme of the organic electro luminescence display as shown in FIG. 1.

FIG. 4 is a diagram showing a second embodiment of driving the organic electro luminescence display as shown in FIG. 1. Referring to FIG. 4, FIG. 4(*a*) represents an actually inputted video data, FIG. 4(*b*) represents an image displayed in the pixel unit according the change in time, and FIG. 4(*c*) represents a graph showing the change in an electric current according to the change in time. And, assume that the range limit of the electric current is 100 mA.

First, a first frame and a second frame are displayed with a white color by use of the inputted video data, as shown in FIG. 4(*a*). However, the first frame and the second frame are displayed as shown in FIG. 4(*b*) due to the time lag while the data is inputted to the pixels, etc. That is to say, after a certain time passes in the first frame, a data signal is supplied to ⅓ of the screen, and after a certain time also passes in the first frame, a data signal is supplied to ⅔ of the screen. Also, after a certain time passes in the first frame, a data signal is supplied to the entire screen. And, in the case of the second frame, a region displayed in the screen is also enlarged with the passage of time in the same manner as in the first frame.

If an electric current capacity flowing in the pixel unit reaches the range limit of the electric current when about ⅔ of the screen is displayed in the step of summing data in the first frame, then the remaining ⅓ of the pixel unit receives data to display black color (black data). Since electric current does not flow in the pixels receiving the black data, the amount of the electric current flowing in the pixel unit does not exceed the range limit of the electric current.

And, an electric current flows along with the range limit since a pulse width of the light emission control signal is controlled in the second frame. At this time, a pulse width of the light emission control signal, supplied to an upper part of the pixel unit at a beginning stage of the second frame, is determined by the range limit of the electric current, since the light emission control signal is sequentially supplied during one frame period, and therefore a small amount of the electric current flows in the pixel unit. And, an electric current does not flow in pixels arranged in a lower part of the pixel unit, since data inputted to the pixels arranged in a lower part of the pixel unit is a black data supplied during a first frame period, and therefore the electric current flows in the pixel unit at a lower level than the range limit. Electric current flows within the range limit if the second frame is completed, and electric current corresponding to the range limit flows in the pixel unit from a third frame.

Accordingly, unreasonable impact on the power supply unit is prevented since the electric current capacity flowing in the first frame and the second frame does not exceed the range limit.

In the driving method as described above, if the data summed in the control unit in the step of summing data of one frame is greater than a predetermined value, a black data is supplied to the data driver from that time point to a time point that a corresponding frame is completed, and therefore an electric current does not flow in the pixel unit any more.

Figure 5:
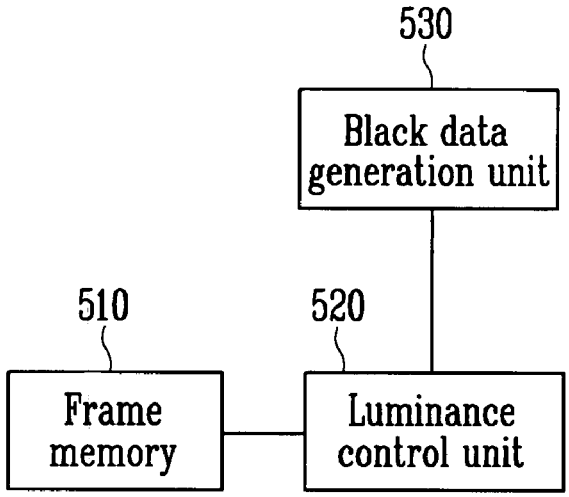
FIG. 5 is a schematic view showing blocks of a control unit used for driving the organic electro luminescence display as proposed in the driving scheme shown in FIG. 4.

FIG. 5 is a schematic view showing blocks of a control unit used for the organic electro luminescence display driven as shown in FIG. 4. Referring to FIG. 5, the control unit includes a frame memory 510, a luminance control unit 520 and a black data generation unit 530.

The frame memory 510 receives and store video data (RGB data) inputted from the outside. The luminance control unit 520 estimates the sum of grey level values of the video data inputted to one frame to determine a luminance range limit of the one frame. The black data generation unit 530 is a means for outputting a black data from the data driver if a video data inputted to one frame exceeds the reference value while the video data is summed in the luminance control unit 520, and the black data generation unit 530 may store a black data and supply the stored black data to the data driver, or control a driving voltage of the data driver to output a black voltage from the data driver.

Figure 6:
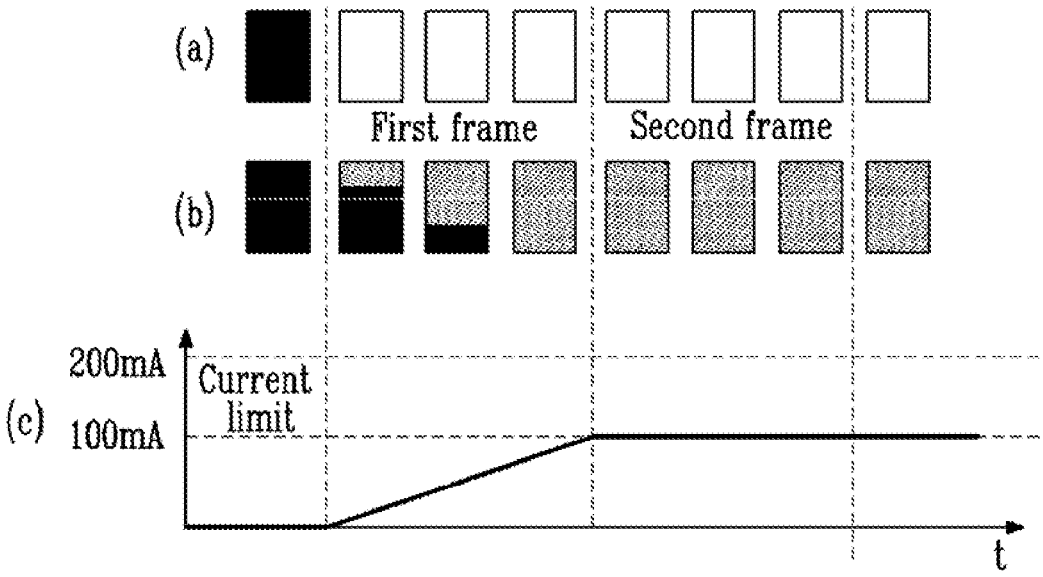
FIG. 6 is a diagram showing principles of a third embodiment of a driving scheme of the organic electro luminescence display as shown in FIG. 1.

FIG. 6 is a diagram showing a third embodiment of driving principles of the organic electro luminescence display as shown in FIG. 1. Referring to FIG. 6, FIG. 6(*a*) represents an actually inputted video data. FIG. 6(*b*) represents an image displayed in the pixel unit according to the change in time. FIG. 6(*c*) represents a graph showing the change in an electric current according to the change in time. The range limit of the electric current is assumed to be 100 mA.

First, a first frame and a second frame are displayed with a white color by the use of the inputted video data, as shown in FIG. 6(*a*). However, the first frame and the second frame are displayed as shown in FIG. 6(*b*) due to the time lag while the data is inputted to the pixels, etc. That is to say, after a certain time passes in the first frame, a data signal is supplied to ⅓ of the screen, and after a certain time also passes in the first frame, a data signal is supplied to ⅔ of the screen. Also, when a certain time passes in the first frame, a data signal is supplied to the entire screen. And, in the case of the second frame, a region displayed in the screen is also enlarged with the passage of time in the same manner as in the first frame.

If the first frame is displayed in the pixel unit, first, an amount of electric current is limited at a beginning stage of the first frame, since a pulse width of the light emission control signal is determined after a video data inputted to the first frame is summed in the luminance control unit, and the pulse width of the light emission control signal is controlled by the luminance control unit when the generated data signal is supplied to the pixel unit by means of the video data corresponding to the first frame. Accordingly, an amount of electric current flowing in the pixel unit does not exceed the range limit of the electric current.

Even if the second frame is displayed in the pixel unit, an electric current capacity is also limited at a beginning stage of the second frame since a pulse width of the light emission control signal is already determined after a video data corresponding to the second frame is summed in the luminance control unit.

For this purpose, an amount of electric current flowing in the pixel unit does not exceed the range limit of the electric current.

Figure 7:
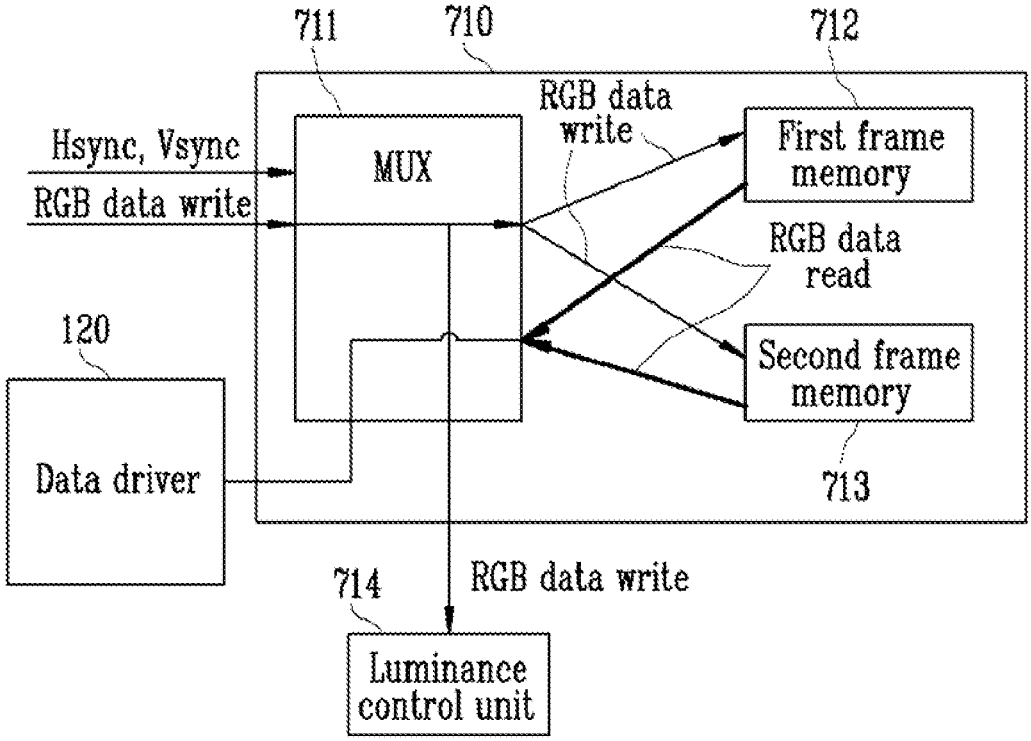
FIG. 7 is a schematic view showing blocks of a control unit used for driving the organic electro luminescence display as proposed in the driving scheme shown in FIG. 6.

FIG. 7 is a schematic view showing blocks of a control unit used for the organic electro luminescence display driven as shown in FIG. 6. Referring to FIG. 7, a video data is one of a first frame memory 712 and a second frame memory 713 by means of a MUX (a selection unit) 711, wherein the second frame memory 713 writes a data when the first frame memory 712 reads a data, and the second frame memory 713 reads a data when the first frame memory 712 writes a data. The MUX 711 receives a horizontal synchronizing signal (Hsync), a vertical synchronizing signal (Vsync) and a video data (RGB data) to perform the selective reading and writing operations of the first frame memory 712 and the second frame memory 713.

In the above-mentioned operations, if a horizontal synchronizing signal (Hsync), a vertical synchronizing signal (Vsync) and a video data corresponding to the first frame are supplied to the MUX 711, then the video data corresponding to the first frame is written in the first frame memory 712 and supplied to the luminance control unit 714. At this time, the video data is stored in the first frame memory 712, and the luminance control unit 714 sums grey level value of the video data corresponding to the first frame to determine a pulse width of the light emission control signal.

If a horizontal synchronizing signal (Hsync), a vertical synchronizing signal (Vsync) and a video data corresponding to the second frame are supplied to the MUX 711, the video data corresponding to the second frame is written in the second frame memory 713 and supplied to the luminance control unit 714. At this time, the video data is stored in the second frame memory 713, and the luminance control unit 714 sums grey level value of the video data corresponding to the second frame to determine a pulse width of the light emission control signal.

The video data corresponding to the first frame stored in the first frame memory 712 is read in the data driver 120 to generates a data signal when the video data corresponding to the second frame is written in the second frame memory 713, and the video data stored in the second frame memory 713 is read in the data driver 120 to generates a data signal when the video data corresponding to the third frame is written in the first frame memory 712.

Also, the data driver supplies the data signal corresponding to the first frame to the pixel unit when a light emission control signal is supplied from the scan driver to the pixel unit to correspond to the pulse width of the light emission control determined by the video data stored in the first frame memory 712 by means of the luminance control unit, and the data driver supplies the data signal corresponding to the second frame to the pixel unit when a light emission control signal is supplied from the scan driver to the pixel unit to correspond to a pulse width of the light emission control determined by the video data stored in the second frame memory 713 by means of the luminance control unit.

Accordingly, the luminance is prevented from exceeding a predetermined value since the pulse width of the light emission control signal is controlled from a time point when the first frame is displayed in the pixel unit. Accordingly, an excessive amount of electric current is prevented from flowing in the pixel unit.

Figure 8:
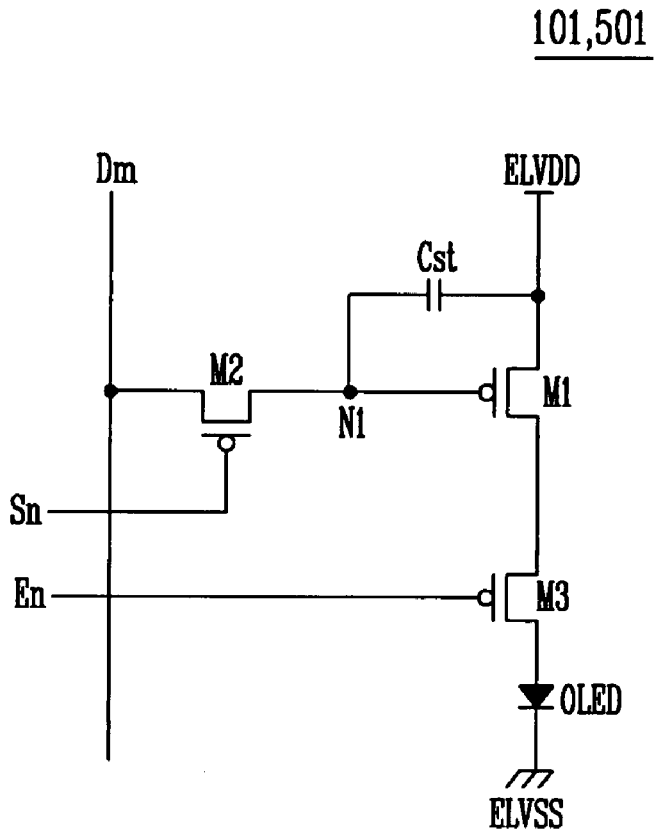
FIG. 8 is a circuit view showing a pixel of one embodiment of the organic electro luminescence display as shown in FIG. 1.

FIG. 8 is a circuit view showing one embodiment of a pixel used for the organic electro luminescence display as shown in FIG. 1. Referring to FIG. 8 the pixel includes a first transistor (M1), a second transistor (M2), a third transistor (M3), a capacitor (Cst) and an organic light emitting diode (OLED).

The first transistor (M1) has a source supplied to a first power source (ELVDD), a drain connected to a source of a third transistor (M3), and a gate connected to a first node (N1). The second transistor (M2) has a source connected to a data line (Dm), a drain connected to a first node (N1), and a gate connected to a scan line (Sn). The third transistor (M3) has a source connected to a drain of the first transistor (M1), a drain connected to an anode electrode of the organic light emitting diode (OLED), and a gate connected to a light emission control line (En). The capacitor (Cst) has a first electrode connected to a first power source; and a second electrode connected to the first node (N1). And, The organic light emitting diode (OLED) includes an anode electrode, a cathode electrode and a light emission layer arranged between the anode electrode and the cathode electrode and emitting light if electric current flows from the anode electrode to the cathode electrode, wherein the anode electrode is connected to a drain of the third transistor (M3) and the cathode is connected to the second power source (ELVSS).

In an operation of the pixel, if the scan signal is in a LOW state to turn on the second transistor (M2), then the data signal supplied through the data line (Dm) is supplied to the first node (N1), and therefore the data signal is supplied to a second electrode of the capacitor (Cst). At this time, a voltage of the first power source (ELVDD) is supplied to the first electrode of the capacitor (Cst). If the scan signal is in a HIGH state to turn off the second transistor (M2), then a floating state is formed between the first node (N1) and the data line (Dm), and a voltage of the first node (N1) sustains voltage of the data signal using the capacitor (Cst). And, the voltage of the first node (N1) is supplied to a gate of the first transistor (M1), and then an electric current flows from the source to the drain electrode of the first transistor (M1) to correspond to the voltage of the first node (N1). At this time, the third transistor (M3) is turned on/off by means of the light emission control signal. In this case, the organic light emitting diode (OLED) does not emit light since a flow of electric current supplied to the organic light emitting diode (OLED) is interrupted if the third transistor (M3) is turned off by means of the light emission control signal. On the while, the organic light emitting diode (OLED) emits light since electric current flows in the organic light emitting diode (OLED) if the third transistor (M3) is turned on by means of the light emission control signal. And, the electric current capacity flowing in the organic light emitting diode (OLED) may be controlled by means of the pulse width of the light emission control signal since a time when the third transistor (M3) is sustained with an ON state may be controlled by means of the pulse width of the light emission control signal.

Figure 9:
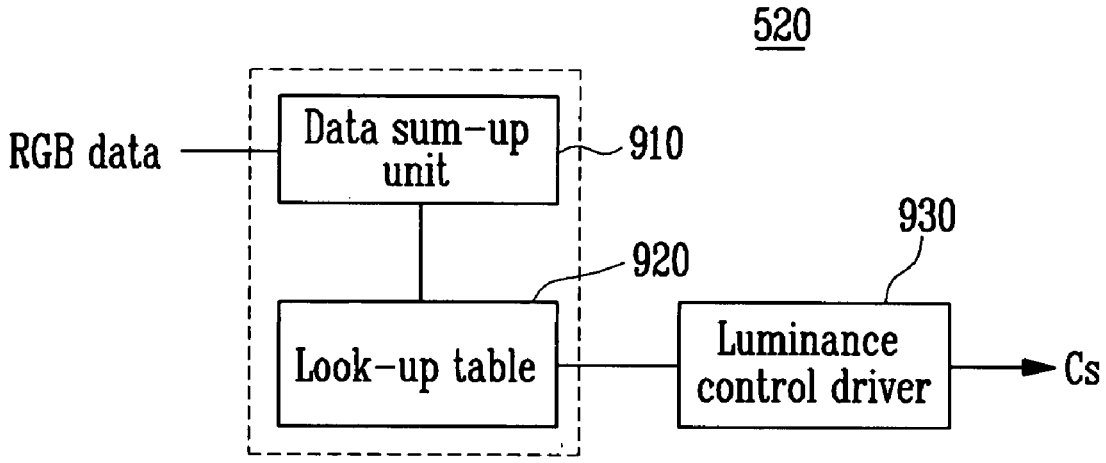
FIG. 9 is a schematic view showing blocks of the luminance control unit shown in FIGS. 3, 5 and 7.

FIG. 9 is a schematic view showing blocks of a luminance control unit as shown in FIGS. 3, 5 and 7. Referring to FIG. 9, the luminance control unit 330, 520 or 714 includes a data sum-up unit 910, a look-up table 920 and a luminance control driver 930.

The data sum-up unit 910 is a means for calculating the sum of a video data inputted to one frame, and the data sum-up unit 910 sums up grey level values of the inputted video data. The grey level values of the video data are referred to as a frame data. It is estimated that a large number of the pixels emit light with a high luminance if the frame data summed in the data sum-up unit 910 has a high value, while it is estimated that a small number of the pixels emit light with a high luminance if the frame data summed in the data sum-up unit 910 has a small value. And, the luminance range limit is determined by the sum of these video data.

The look-up table 920 stores a pulse number, a pulse width and a gap between the pulse and the pulse of the light emission control signal which is formed according to the luminance range limit estimated using the sum of the video data summed up in the data sum-up unit 910. Also, the luminance range limit may be assigned using some bits of the video data in order to reduce a size of the look-up table 920.

The luminance control driver 930 generates a luminance control signal corresponding to the light emission control signal assigned along with the luminance range limit. The luminance control signal is inputted to the scan driver to generate a light emission control signal in the scan driver to correspond to the luminance control signal.

The organic electro luminescence display and the driving method of the same according to the present invention may be useful to reduce a power consumption and improve a contrast. Also, the large loading to the power supply unit may be prevented by controlling an amount of electric current if the pixel unit emits light with a high luminance at a beginning stage.

The description proposed herein is just a preferable example for the purpose of illustrations only, not intended to limit the scope of the invention, so it should be understood that other equivalents and modifications could be made thereto without departing from the spirit and scope of the invention as apparent to those skilled in the art. Therefore, it should be understood that the present invention might be not defined within the scope of which is described in detailed description but within the scope of which is defined in the claims and their equivalents.

What is claimed is:

1. An organic electro luminescence display comprising:

a pixel unit for displaying an image that is composed of a plurality of frames;

a scan driver for supplying a scan signal and a light emission control signal to the pixel unit;

a data driver for generating a data signal from a video data and for supplying the generated data signal to the pixel unit; and a control unit coupled to each of the scan driver and the data driver, the control unit controlling a pulse width of the light emission control signal using a frame data which is a sum of grey levels of the video data inputted in a frame, and controlling a frame period of the frame according to a size of the frame data.

2. The organic electro luminescence display according to claim 1, wherein the control unit comprises:

a frame memory for storing a video data of a frame;

a data sum-up unit for summing the video data stored in the frame memory to generate a frame data;

a look-up table for storing information of the light emission control signal corresponding to the frame data; and a luminance control signal driver for outputting a luminance control signal using the information of the light emission control signal stored in the look-up table.

3. The organic electro luminescence display according to claim 2, wherein the light emission control signal is generated to correspond to a luminance control signal.

4. The organic electro luminescence display according to claim 1, wherein a light emission time of the pixel unit is controlled per one frame to correspond to the light emission control signal.

5. The organic electro luminescence display according to claim 1, wherein the scan driver includes a scan drive circuit for generating the scan signal and a light emission control drive circuit for generating the light emission control signal.

6. The organic electro luminescence display according to claim 2, wherein the pixel unit has longer light emission time sustained during the one frame period in case that a size of the frame data is small, and the pixel unit has shorter light emission time sustained during the one frame period in case that a size of the frame data is large.

7. The organic electro luminescence display according to claim 1, wherein the control unit determines whether the inputted image is a still image or a moving image.

8. The organic electro luminescence display according to claim 7, wherein the control unit includes a clock generation unit, and a frequency of a clock generated in the control unit is higher if the inputted image is a still image than if the inputted image is a moving image.

9. The organic electro luminescence display according to claim 7, wherein the control unit determines whether the inputted image is a still image or a moving image based on the size of the frame data.

10. The organic electro luminescence display according to claim 1, wherein the data driver generates a black data signal and supplies the generated black data signal to the pixel unit in case that a size of the frame data is greater than a predetermined value.

11. The organic electro luminescence display according to claim 10, wherein the control unit comprises:

a frame memory for storing a video data of a frame;

a data sum-up unit for summing the video data stored in the frame memory to generate a frame data;

a look-up table for storing information of the light emission control signal corresponding to the frame data; and a luminance control signal driver for outputting a luminance control signal using the information of the light emission control signal stored in the look-up table.

12. The organic electro luminescence display according to claim 11, wherein the control unit supplies the black data to the data driver until one frame period is finished if the video data is greater than a predetermined value during a period in which the video data is summed in the data sum-up unit.

13. The organic electro luminescence display according to claim 11, wherein the control unit controls an output voltage of the data driver to make the pixel unit display a black color if the video data summed in the data sum-up unit is greater than a predetermined value.

14. An organic electro luminescence display comprising:

a pixel unit for displaying an image that is composed of a plurality of frames;

a scan driver for supplying a scan signal and a light emission control signal to the pixel unit;

a data driver for generating a data signal from a video data and for supplying the generated data signal to the pixel unit; and a control unit coupled to each of the scan driver and the data driver, the control unit controlling a pulse width of the light emission control signal using a frame data which is a sum of grey levels of the video data inputted in a frame, and controlling a frame period of the frame according to a size of the frame data, the control unit including at least two memories, a first frame and a second frame of the image being stored in different memories.

15. The organic electro luminescence display according to claim 14, wherein the control unit comprises:

a data sum-up unit for summing up a video data to generate a frame data;

a look-up table for storing information of the light emission control signal corresponding to the frame data; and a luminance control signal driver for outputting a luminance control signal using the information of the light emission control signal stored in the look-up table.

16. The organic electro luminescence display according to claim 14, wherein the scan driver is divided into a scan drive circuit for generating the scan signal and a light emission control drive circuit for generating the light emission control signal.

17. The organic electro luminescence display according to claim 14, wherein the memories of the control unit includes a first frame memory and a second frame memory to selectively supply a video data to the first frame memory or the second frame memory by means of a selection unit, the video data corresponding to the first frame and the second frame.

18. A method for driving an organic electro luminescence display which includes a pixel unit for displaying an image that is composed of a plurality of frames, the method comprising:

estimating a frame data which is a sum of a video data stored in a frame memory;

controlling a frame period of the frame according to a size of the frame data;

estimating a luminance range limit of the pixel unit from the frame data; and generating a light emission control signal according to the luminance range limit, a pulse width and a pulse number of the light emission control signal being determined to correspond to the luminance range limit.

19. The method for driving an organic electro luminescence display according to claim 18, wherein the step of generating the light emission control signal including a step of looking up a look-up table for a pulse width of the light emission control signal corresponding to the total sum of the video data.

20. The method for driving an organic electro luminescence display according to claim 18, wherein a light emission time of the pixel unit is reduced to correspond to a size of the frame data, wherein the light emission time of the pixel unit is shorter if the size of the frame data is large than if the size of the frame data is small.

21. The method for driving an organic electro luminescence display according to claim 18, wherein, in the step of estimating the frame data, the one frame period is controlled by changing a frequency of the clock.

22. A method for driving an organic electro luminescence display which includes a pixel unit for displaying an image that is composed of a plurality of frames, the method comprising:

estimating a frame data which is a sum of a video data stored in a frame memory;

supplying a black data through a data signal that is supplied to the pixel unit if a size of the frame data is greater than a predetermined value;

controlling a frame period of the frame according to a size of the frame data;

estimating a luminance range limit of the pixel unit from the frame data; and generating a light emission control signal according to the luminance range limit, a pulse width and a pulse number of the light emission control signal being determined to correspond to the luminance range limit.

23. The method for driving an organic electro luminescence display according to claim 22, wherein a black data is supplied through the data signal until one frame period is finished if the size the video data is greater than a predetermined value.

24. A method for driving an organic electro luminescence display which includes a pixel unit for displaying an image that is composed of a plurality of frames, the method comprising:

storing a video data of a first frame in a first frame memory;

summing the stored video data of the first frame to generate a first frame data of the first frame after the video data of the first frame is stored;

controlling a frame period of the first frame according to a size of the first frame data;

estimating a luminance range limit of the pixel unit from the first frame data;

generating a first light emission control signal according to the luminance range limit from the first frame data, a pulse width and a pulse number of the first light emission control signal being determined to correspond to the luminance range limit from the first frame data;

storing a video data of a second frame in a second frame memory;

summing the stored video data of the second frame to generate a second frame data of the second frame after the video data of the second frame is stored;

controlling a frame period of the second frame according to a size of the second frame data;

estimating a luminance range limit of the pixel unit from the second frame data; and generating a second light emission control signal according to the luminance range limit from the second frame data, a pulse width and a pulse number of the second light emission control signal being determined to correspond to the luminance range limit from the second frame data.

25. The method for driving an organic electro luminescence display according to claim 24, wherein a light emission time of the pixel unit is reduced to correspond to a size of the frame data, wherein the light emission time of the pixel unit is shorter if the size of the frame data is large than if the size of the frame data is small.

* * * * *